US010967886B2

(12) United States Patent
Vergnaud et al.

(10) Patent No.: US 10,967,886 B2
(45) Date of Patent: Apr. 6, 2021

(54) DRAFT SILL USING A TENSION CABLE

(71) Applicant: BOMBARDIER TRANSPORTATION GMBH, Berlin (DE)

(72) Inventors: Simon Vergnaud, Montreal (CA); Daniel Koudolo, Montreal (CA); André Gagnon, Boucherville (CA)

(73) Assignee: Bombardier Transportation GmbH, Berlin (DE)

( * ) Notice: Subject to any disclaimer, the term of this patent is extended or adjusted under 35 U.S.C. 154(b) by 313 days.

(21) Appl. No.: 16/152,906

(22) Filed: Oct. 5, 2018

(65) Prior Publication Data

US 2020/0108845 A1 Apr. 9, 2020

(51) Int. Cl.
*B61G 11/16* (2006.01)
*B61F 1/10* (2006.01)

(52) U.S. Cl.
CPC ..... *B61G 11/16* (2013.01); *B61F 1/10* (2013.01)

(58) Field of Classification Search
CPC ..... B61F 1/00; B61F 1/10; B61F 1/14; B61G 7/00; B61G 7/14; B61G 9/00; B61G 9/04; B61G 9/10; B61G 9/18; B61G 9/24; B61G 11/00; B61G 11/14
See application file for complete search history.

(56) References Cited

U.S. PATENT DOCUMENTS

| | | | | |
|---|---|---|---|---|
| 3,247,977 | A * | 4/1966 | Dilg | B61G 7/14 213/9 |
| 3,255,891 | A * | 6/1966 | Cope | A01B 23/02 213/19 |
| 3,710,951 | A * | 1/1973 | Cope | B61G 7/12 213/15 |
| 4,576,294 | A * | 3/1986 | Forster | B61G 3/16 213/1 A |
| 9,758,182 | B2 * | 9/2017 | Peckham | B61G 7/12 |
| 2015/0298712 | A1 | 10/2015 | Hirashima et al. | |

FOREIGN PATENT DOCUMENTS

| | | | |
|---|---|---|---|
| CN | 102438873 | A | 5/2012 |
| CN | 203543997 | U | 4/2014 |
| DE | 1005548 | B | 4/1957 |
| JP | 2005081942 | A | 3/2005 |
| JP | 2016107936 | A | 6/2016 |

* cited by examiner

*Primary Examiner* — Robert J McCarry, Jr.
(74) *Attorney, Agent, or Firm* — The Webb Law Firm

(57) ABSTRACT

A rail car includes an elongated floor supporting a rail car body, a draft sill depending from the floor, and a crash energy management (CEM) system. The CEM system includes a coupler plate coupled to the draft sill and depending from the floor between the draft sill and a first end of the floor, a coupler support depending from the floor between the coupler plate and the first end of the floor, an elongated coupler assembly extending from the coupler plate in a direction of the first end of the floor via an opening defined by the coupler support, and at least one cable connected in tension between the coupler support and the coupler plate.

27 Claims, 8 Drawing Sheets

DRAFT SILL USING A TENSION CABLE

BACKGROUND OF THE INVENTION

Field of the Invention

The present invention relates to rail cars and, more particularly, to an improved crash energy management system used on the ends of rail cars.

Description of Related Art

In rail cars where it is desired to move the bogies and wheels closer to the ends of the car, there is a corresponding need to not only reposition the draft sills but to also redesign the draft sills to accommodate this movement of the bogies. Because of the repositioning and the redesign of the draft sills, there is a need to provide additional stiffness and strength to the rail car, especially the floor of the rail car, between each draft sill and the end of the rail car proximate to said draft sill while, simultaneously, maintaining the ability of the end of the rail car to absorb and dissipate the force of an impact, such as might occur in a crash.

SUMMARY OF THE INVENTION

Generally, provided, in one preferred and non-limiting embodiment or example, is a compact and lightweight crash energy management (CEM) system.

Further preferred and non-limiting embodiments or examples are set forth in the following numbered clauses.

Clause 1: A rail car comprising: an elongated floor supporting a rail car body; an end frame proximate a first end of the floor; a draft sill depending from the floor; and a crash energy management (CEM) system comprising: a coupler plate coupled to the draft sill and depending from the floor between the draft sill and a first end of the floor; an elongated coupler assembly extending from the coupler plate in a direction of the first end of the floor; and at least one cable connected between the coupler plate and the end frame.

Clause 2: The rail car of clause 1, wherein each cable can have a first end connected to the end frame proximate the floor and a second end connected to the coupler plate proximate a portion thereof opposite the floor.

Clause 3: The rail car of clause 1 or 2, wherein each cable can be connected in tension between the end frame and the coupler plate.

Clause 4: The rail car of any one of clauses 1-3, wherein the tension of each cable can be between about 22 kilonewtons (kN) and about 40 kN.

Clause 5: The rail car of any one of clauses 1-4, wherein the at least one cable can include: a first cable connected between the end frame and the coupler plate on one side of the floor; and a second cable connected between the end frame and the coupler plate on an opposite side of the floor.

Clause 6: The rail car of any one of clauses 1-5 can further include a bogie having wheels coupled to the floor proximate an end of the draft sill opposite the end frame.

Clause 7: The rail car of any one of clauses 1-6, wherein the coupler plate can include top and bottom edges extending laterally between sides of the floor, wherein the top edge can be coupled to the floor and the bottom edge can be positioned away from the floor opposite the top edge; a pair of side edges that extend between the top and bottom edges of the coupler plate on opposite sides of the coupler plate; a first face to which a first end of the coupler assembly can be connected; and a second face that faces away from the coupler assembly.

Clause 8: The rail car of any one of clauses 1-7, wherein the at least one cable can be connected to the end frame via a coupler support. The coupler support can depend from the end frame.

Clause 9: The rail car of any one of clauses 1-8, wherein: the coupler support can be U-shaped including a pair of arms extending from a cross-member that extends laterally between sides of the end-frame; the end of each arm opposite the cross-member can be coupled to the end frame; and an opening can be defined between the end frame and the U-shape of the coupler support.

Clause 10: The rail car of any one of clauses 1-9, wherein the coupler assembly can include a coupler on an end of the coupler assembly opposite the coupler plate and a shock absorber between the coupler and the coupler plate.

Clause 11: The rail car of any one of clauses 1-10, further comprising the coupler assembly connected to the coupler plate and extending towards the end frame and through the opening of the coupler support, the coupler assembly having a shock absorber.

Clause 12: The rail car of any one of clauses 1-11 can further comprise: a second end frame proximate a second end of the floor; a second draft sill depending from the floor, wherein the draft sill can be positioned between the first end of the floor and a position intermediate the first end and a second end of the floor, and the second draft sill can be positioned between the second end of the floor and the position intermediate the first and second ends of the floor; and a second CEM system comprising: a second coupler plate coupled to the second draft sill and depending from the floor between the second draft sill and the second end of the floor; a second elongated coupler assembly extending from the second coupler plate in a direction of the second end of the floor; and at least one cable connected between the second coupler support and the second coupler plate.

Clause 13: The rail car of any one of clauses 1-12, wherein each cable connected between the second end frame and the second coupler plate is in tension and can have a first end connected to the second end frame proximate the floor and a second end connected to the second coupler plate proximate a portion thereof opposite the floor.

Clause 14: The rail car of any one of clauses 1-13, wherein the at least one cable connected between the second end frame and the second coupler plate can include: a first cable connected between the second end frame and the second coupler plate on one side of the floor; and a second cable connected between the second end frame and the second coupler plate on an opposite side of the floor.

Clause 15: A method of forming a crash energy management system on a rail car comprises an elongated floor supporting a rail car body and a draft sill depending from a bottom of the floor, the method comprising: connecting a coupler plate to the floor between the draft sill and an end of the floor, with the coupler plate extending away from the bottom of the floor; connecting a coupler support to the floor between the coupler plate and the end of the floor, with the coupler support extending away from the bottom of the floor; connecting one end of a coupler assembly having an elongated body to the coupler plate, with the elongated body extending from the coupler plate in a direction of the end of the floor via an opening defined by the coupler support; and connecting at least one cable in tension between the coupler support and the coupler plate.

Clause 16: The method of clause 15 can further include providing each cable pre-tensioned prior to connection between the coupler support and the coupler plate.

Clause 17: The method of clause 15 or 16, wherein the coupler plate can have a first side facing the coupler support, a second side coupled to the draft sill, a top edge coupled to the floor, and a bottom edge facing away from the floor.

Clause 18: The method of any one of clauses 15-17, wherein each cable can have a first end connected to the coupler support proximate the floor and a second end connected to the coupler plate proximate the bottom edge of the coupler plate.

Clause 19: The method of any one of clauses 15-18, wherein the coupler support can include a cross-member spaced from the floor and extending laterally between sides of the floor and a pair of spaced arms extending between the base and the floor, wherein the opening can be defined between the base, the arms, and the floor.

Clause 20: The method of any one of clauses 15-19, wherein the coupler plate and the coupler support can be coupled to the floor in spaced relation.

Clause 21: A rail car body comprises an elongated floor; an end frame proximate a first extremity of the floor; a draft sill depending from the floor, the draft sill having a coupler plate; a crash energy management (CEM) system having a longitudinally collapsible structure, the longitudinally collapsible structure being connected between the end frame and the coupler plate and being operative to absorb at least partially crash energy and transfer loads between the end frame and the coupler plate; and at least one structural cable connected between the draft sill and the end frame, the at least one structural cable being operative to transfer loads between the draft sill and the end frame.

Clause 22: The rail car of clause 21, wherein the at least one cable is connected to the draft sill distal a level of the floor.

Clause 23: The rail car of clause 21 or 22, wherein the at least one cable is connected under tension between the end frame and the draft sill.

Clause 24: The rail car of any one of clauses 21-23, wherein the tension of the at least one cable ranges between 10 kilonewtons (kN) and 40 kN.

Clause 25: The rail car of any one of clauses 21-24, wherein the tension of the at least one cable ranges between 18 kilonewtons (kN) and 25 kN.

Clause 26: The rail car of any one of clauses 21-25, wherein the at least one cable is connected to the end frame proximate a level of the floor.

Clause 27: The rail car body of any one of clauses 21-26, further comprising a coupler support depending from the end frame, the at least one structural cable being connected to the end frame via the coupler support.

Clause 28: The rail car body of any one of clauses 21-27, further comprising an elongated coupler assembly extending from the coupler plate in a direction of the first extremity of the floor via an opening defined by the coupler support.

Clause 29: The rail car body of any one of clauses 21-28, further comprising two structural cables, each one of the two structural cables being located on a different side of the coupler assembly.

Clause 30: The rail car body of any one of clauses 21-29 wherein the collapsible structure of the CEM is operative to collapse longitudinally so that the connected end frame gets longitudinally closer to the draft sill and so that the at least one structural cable is no longer under tension and is no longer operative to transfer loads between the draft sill and the end frame.

Clause 31: A rail car comprising the rail car body of any one of clauses 21-30 and two bogies, each one of the two bogies being located at a different end of the rail car body.

BRIEF DESCRIPTION OF THE DRAWINGS

These and other features of the present invention will become more apparent from the following description in which reference is made to the appended drawings wherein.

DESCRIPTION OF THE INVENTION

Figure 1:
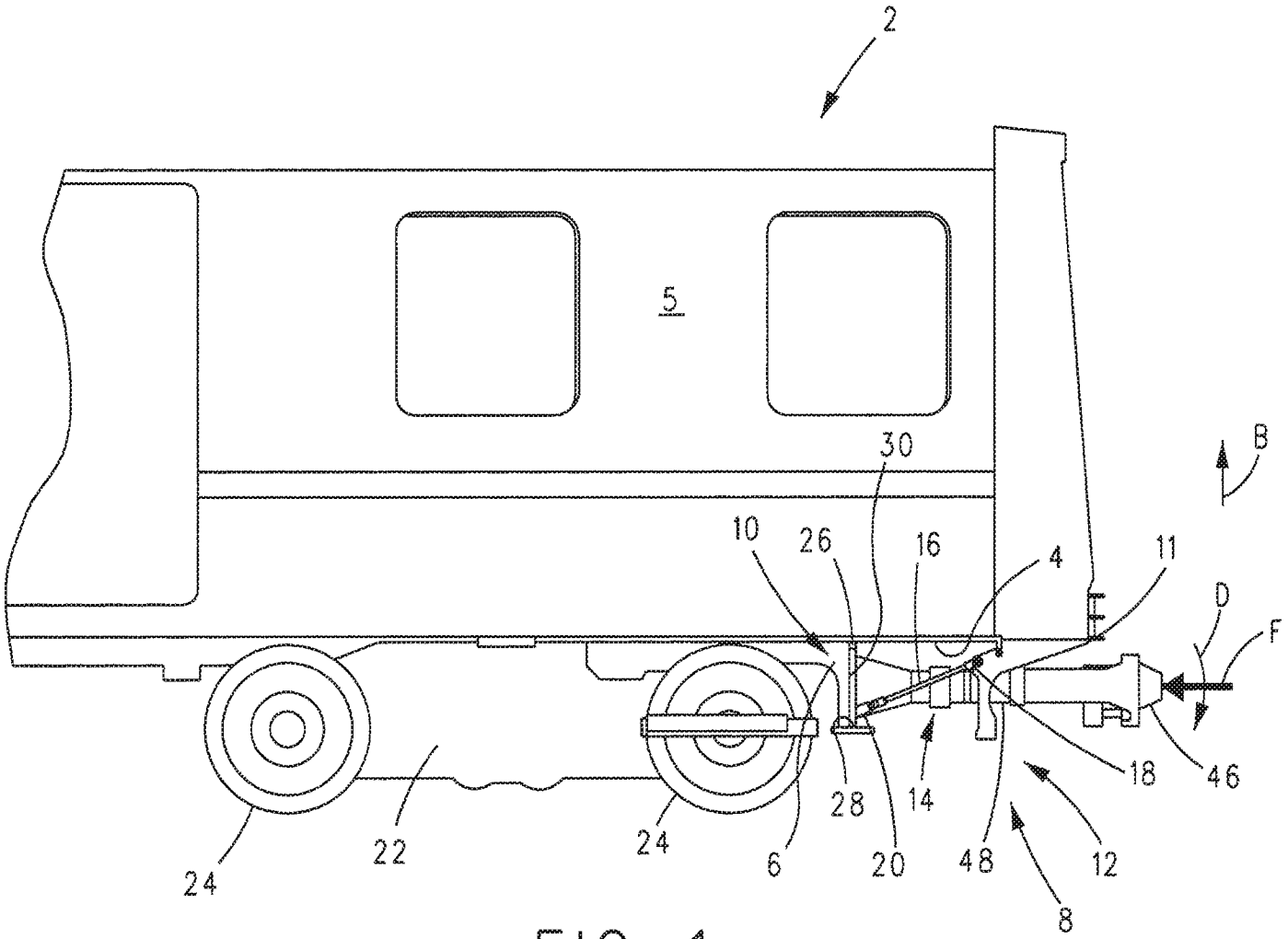
FIG. 1 is a side view of a portion of one end of one preferred and non-limiting embodiment or example rail car including a crash energy management (CEM) system in accordance with the principles described herein.

Various non-limiting examples will now be described with reference to the accompanying figures where like reference numbers correspond to like or functionally equivalent elements.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific examples or aspects disclosed herein are not to be construed as limiting.

Figure 2:
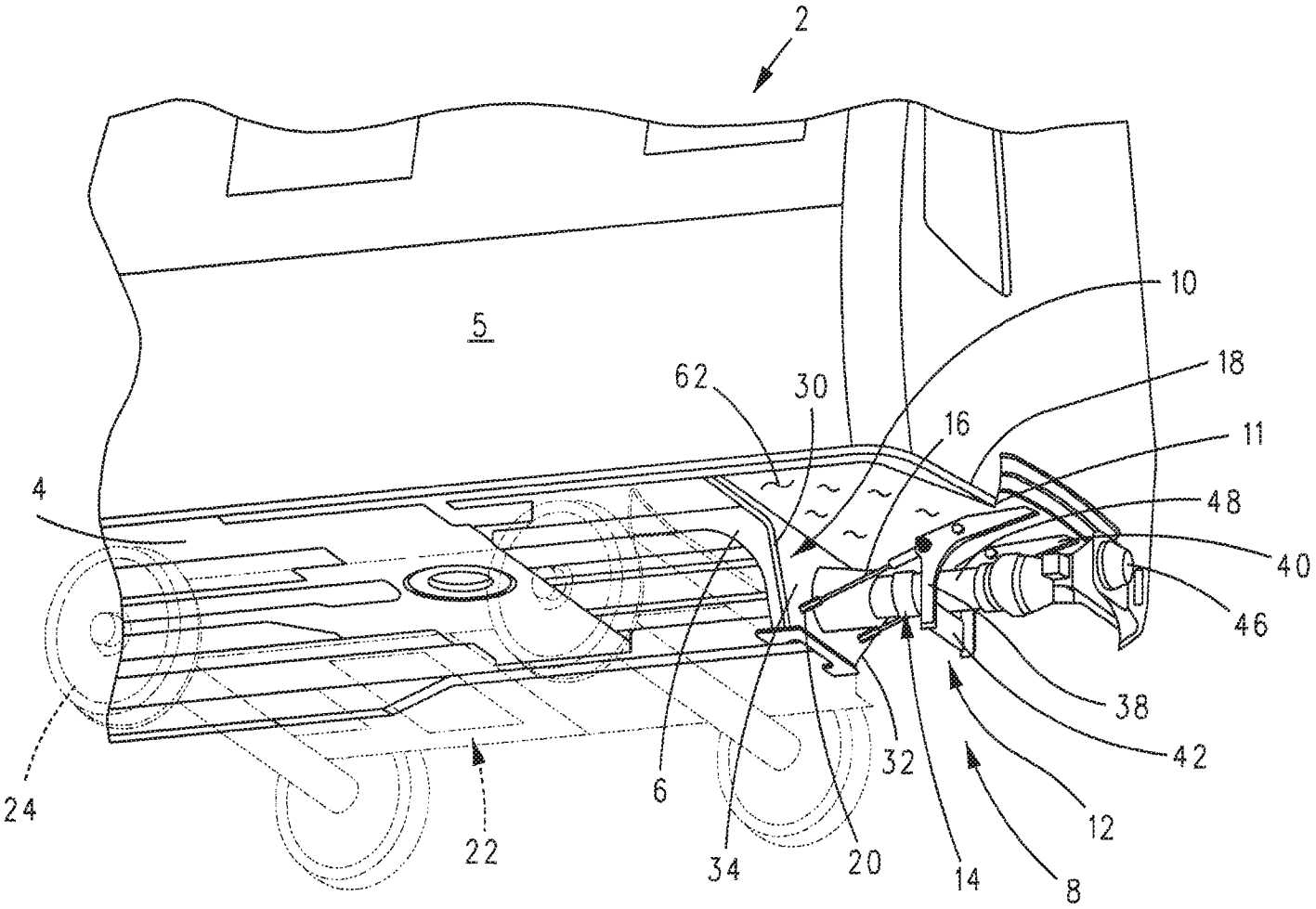
FIG. 2 is a bottom-up perspective view of the end-portion of the rail car of FIG. 1 showing the CEM system, wherein the bogie and the wheels are shown in phantom.
Figure 3:
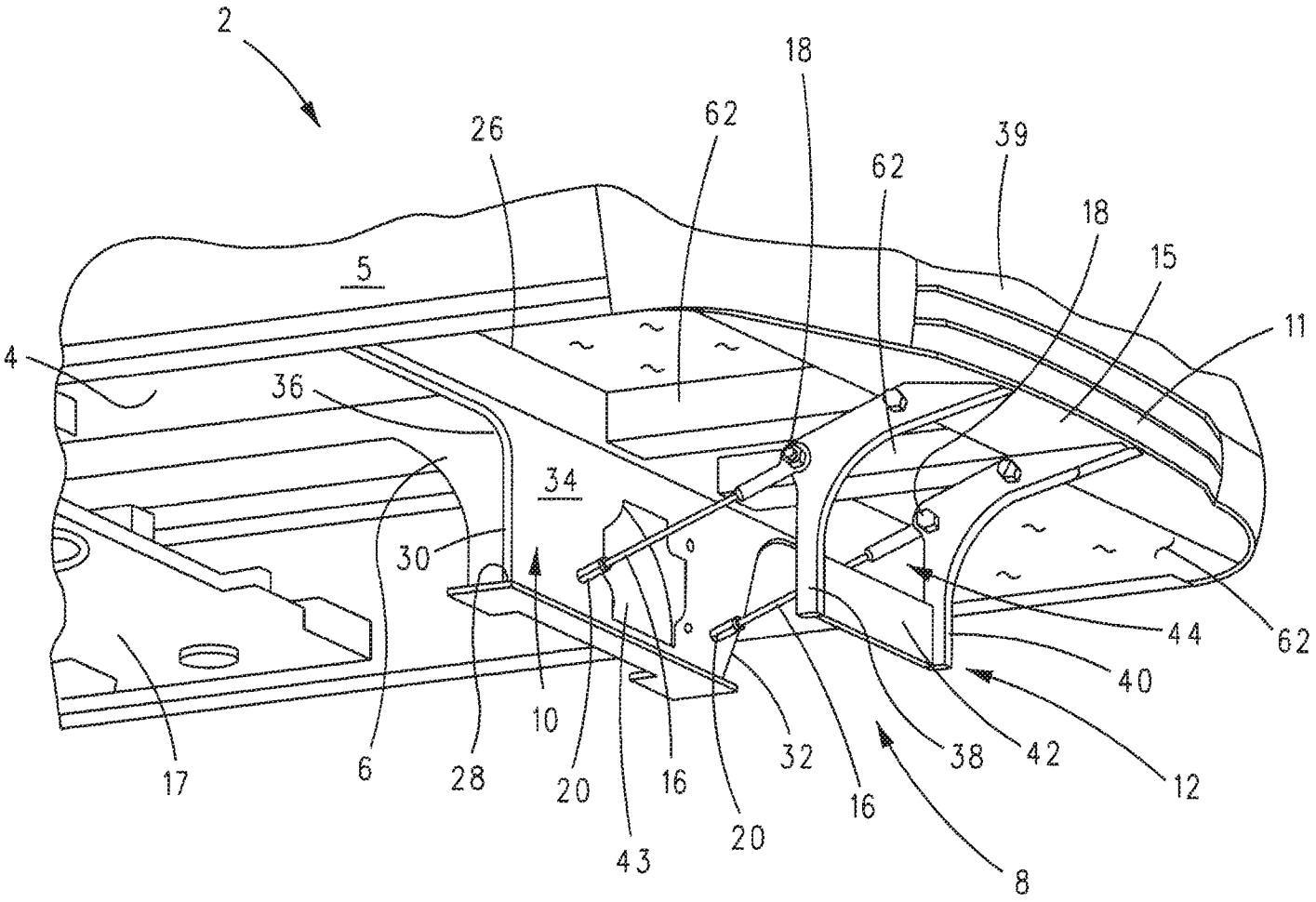
FIG. 3 is an isolated bottom-up perspective view of the CEM system shown in FIG. 2.

Referring to FIGS. 1-3, in one preferred and non-limiting embodiment or example, disclosed herein is a rail car 2 that includes an elongated floor 4 closing a bottom of a rail car body 5. A draft sill 6 depends from the bottom of floor 4. A crash energy management (CEM) system 8 is coupled to the bottom of floor 4 between draft sill 6 and a first end 11 of floor 4. In an example, CEM system 8 can include one or more energy absorbers 62 (coupled to floor 4) that absorb energy by deformation in a manner known in the art. Various types and configurations of energy absorbers 62 are well-known in the art and will not be described further herein.

In one preferred and non-limiting embodiment or example, CEM system 8 includes a coupler plate 10 coupled to draft sill 6 and depending from floor 4 between draft sill 6 and first end 11 of floor 4 or between draft sill 6 and energy absorbers 62. CEM system 8 also includes a coupler support 12 depending from an end frame 15 disposed between coupler plate 10 and first end 11 of floor 4. An elongated coupler assembly 14 has a first end coupled to coupler plate 10 and extends in a direction of first end 11 of floor 4 via an opening 44 (FIG. 3) defined by coupler support 12. Finally, at least one cable 16 can be connected between end frame 15 and coupler plate 10. In one preferred and non-limiting embodiment or example, the at least one cable 16 can be connected between the end frame 15 and the coupler plate 10 via the coupler support 12. In one preferred and non-limiting embodiment or example, the at least one cable 16 can be connected to the coupler support 12, which itself can be connected to the end frame 15.

Figure 4A:
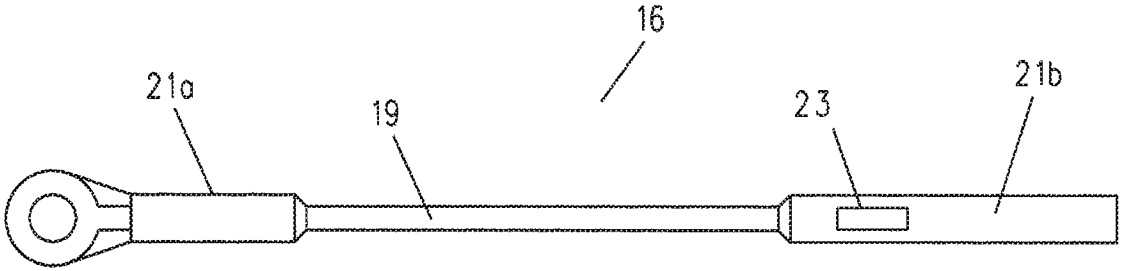
FIG. 4A is a top view of an example structural cable in accordance with the principles described herein that can be part of the CEM of FIG. 1.
Figure 4B:
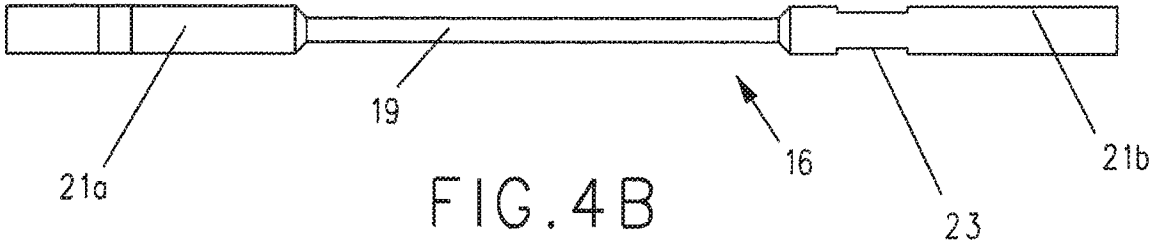
FIG. 4B is a side view of the structural cable of FIG. 4A.

With reference to FIGS. 4A and 4B, in one preferred and non-limiting embodiment or example, the at least one cable 16 can be a flexible structural or mechanical cable, which can be made of wire 19 to which ends terminals 21*a*, 21*b* can be installed. Wire 19 can be made of a steel wire, or any other adequate material which is designed to transfer loads in tension, such as, but not limited to, steel, carbon fibers, glass fibers, etc. Cable 16 can be inherently capable of transferring loads in tension, but not in compression because of its inherent flexibility. Terminals 21*a*, 21*b* may be crimped to wire 19 and can be designed to conveniently mechanically and structurally assemble cable 16 between two elements. In one preferred and non-limiting embodiment or example, such terminals 21 can include a socket terminal, such as terminal 21*a*, or a threaded terminal, such as terminal 21*b*. However, this is not to be construed in a limiting sense. Terminals 21*a*, 21*b* can be designed to be respectively attached to an external element using a screw and a nut. Terminals 21*a* and 21*b* can be crimped to wire 19 so as to transfer tensile loads.

In one preferred and non-limiting embodiment or example, wire 19 can have a minimum ultimate breaking strength of 53.95 kip (~240 kN). In an example, wire 19 and terminals 21*a*, 21*b* may be protected from corrosion by a galvanization treatment. Also or alternatively, a heat shrinkable sheet may be added to cable 16 to provide additional corrosion protection.

In one preferred and non-limiting embodiment or example, cable 16 may be provided with flats spots 23 on its terminals prone to axial rotation, such as threaded terminal 21*b*. These flat spots 23 can be used to avoid cable 16 from rotating under load by mechanically locking these flat spots 23 in place once cable 16 is attached. Indeed, when not constrained and submitted to a tension load, cable 16 may have a natural tendency to twist along its longitudinal axis. When twisted, the mechanical properties of cable 16 can be decreased. An anti-rotational plate (not shown), can be used to engage flat spots 23 to avoid cable 16 from twisting when installed and submitted to a load.

In one preferred and non-limiting embodiment or example, each cable 16 can have a first end 18 connected to coupler support 12 proximate floor 4 and a second end 20 connected to coupler plate 10 proximate a bottom edge 28 opposite or spaced from floor 4. In an example, each cable 16 can be connected in tension between coupler support 12 and coupler plate 10. Alternatively, each cable 16 can be connected directly between coupler plate 10 and end frame 15. The tension of each cable 16 can be between about 22 kilonewtons (kN) and 40 kN. These cables 16 rigidify draft sill 6 (or aid in making draft sill 6 rigid) under normal operation of rail car 2.

In one preferred and non-limiting embodiment or example, the at least one cable 16 can include a first cable 16 connected between coupler support 12 and coupler plate 10 on one side of rail car body 5 and a second cable 16 connected between coupler support 12 and coupler plate 10 on an opposite side of rail car body 5.

In one preferred and non-limiting embodiment or example, rail car 2 can further include a bogie 22, including wheels 24, rotatably coupled to rail car body 5 through a car body bolster 17 proximate an end of draft sill 6 opposite coupler plate 10. In an example, coupler plate 10 can include top and bottom edges 26, 28 (FIG. 3) extending laterally between the sides of rail car body 5. The top edge 26 of coupler plate 10 can be coupled to the bottom of floor 4 and the bottom edge 28 of coupler plate 10 can be positioned facing away from floor 4 opposite top edge 26. Coupler plate 10 can also include a pair of side edges 30, 32 that extend between the top and bottom edges 26, 28 of coupler plate 10 on opposite sides of coupler plate 10. Coupler plate 10 can also include a first face (or side) 34 to which a first end of coupler assembly 14 is connected and a second face (or side) 36 that faces away from coupler assembly 14 toward draft sill 6. In an example, second face 36 of coupler plate 10 can be coupled to one or more downward extensions of draft sill 6, as shown best in FIG. 3. In another example, coupler assembly 14 can be attached to second face 36 and routed towards end 11 through an opening 43 in coupler plate 10.

In one preferred and non-limiting embodiment or example, coupler support 12 can be U-shaped including a pair of arms 38, 40 (FIG. 3) that extend toward floor 4 from a base or cross-member 42 that extends laterally between the sides of rail car body 5. In an example, the end of each arm 38, 40 opposite cross-member 42 can be coupled to floor 4 or end frame 15. The opening 44 through which the body of elongated coupler assembly 14 extends can be defined between floor 4 and the U-shape of coupler support 12, as shown best in FIG. 2.

In one preferred and non-limiting embodiment or example, coupler assembly 14 can include a coupler 46 on an end of coupler assembly 14 opposite coupler plate 10. Coupler assembly 14 can also include a shock absorber 48 between coupler 46 and coupler plate 10.

Figure 5:
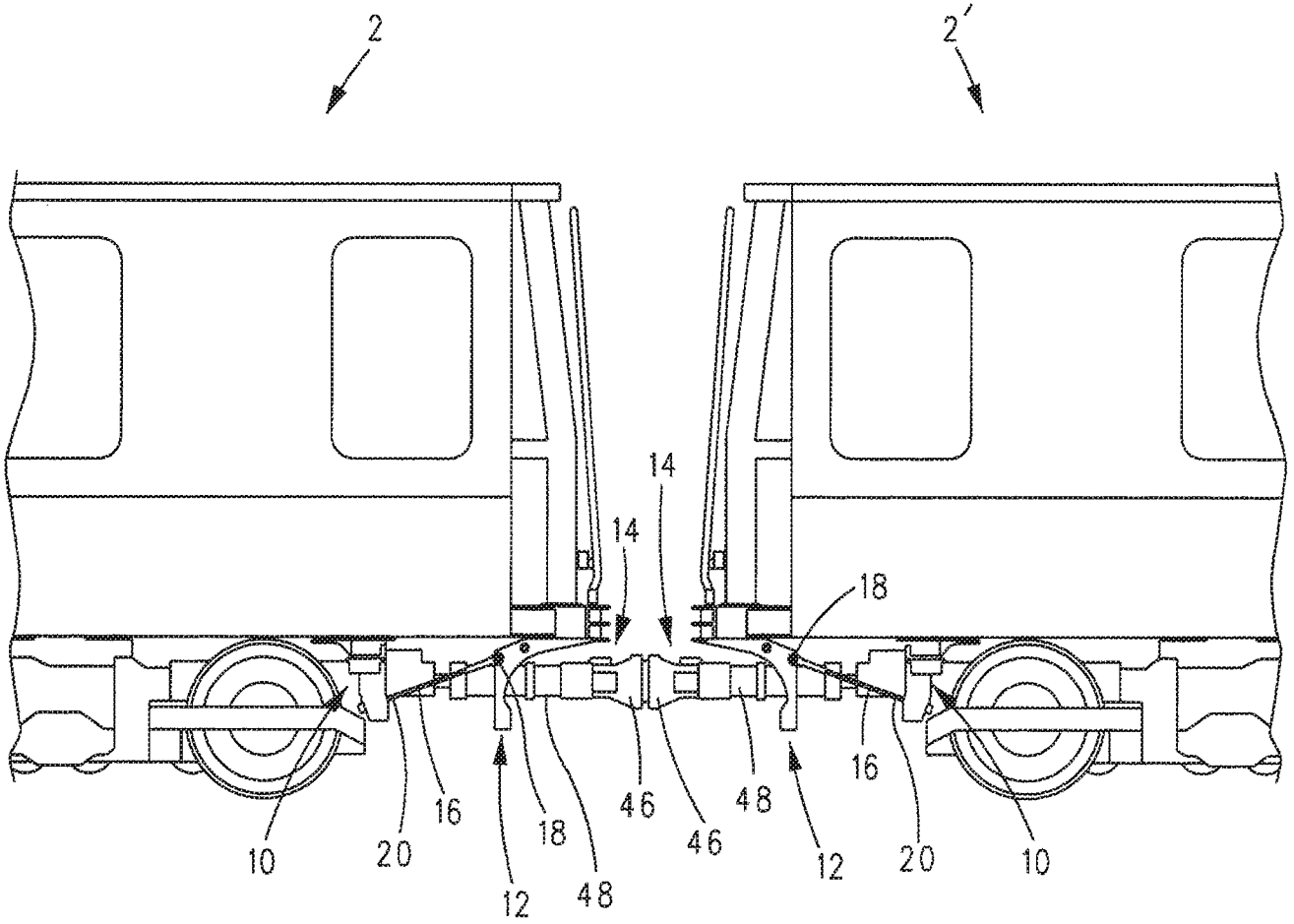
FIG. 5 is a side view of the rail car shown in FIG. 1 showing the CEM system thereof as it undergoes coupling with a CEM system of another rail car under normal operation.
Figure 6:
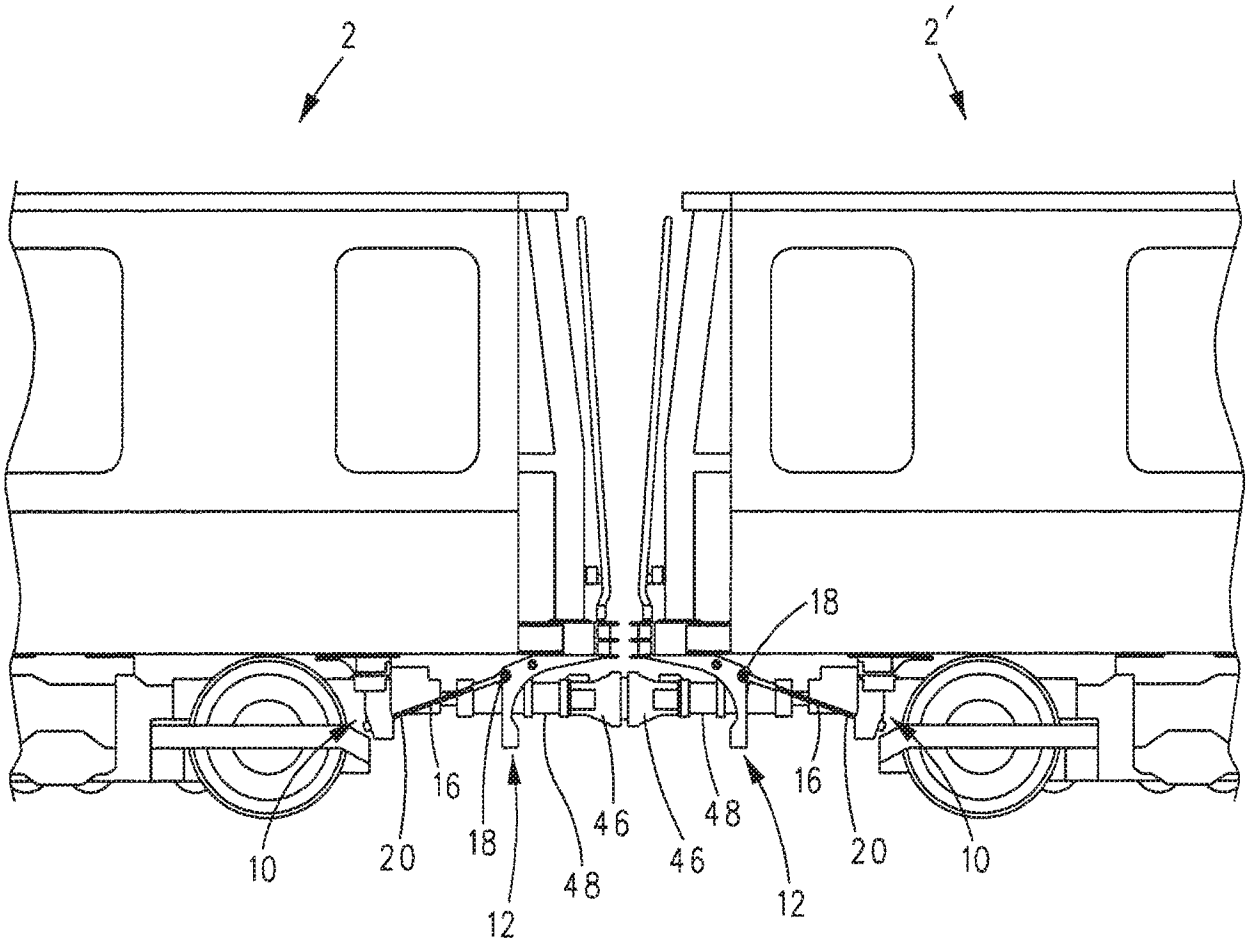
FIG. 6 is a side view of the rail cars shown in FIG. 5 showing the CEM system of the rail car shown in FIG. 1 in a first phase of collision with the CEM system of the other rail car.
Figure 7:
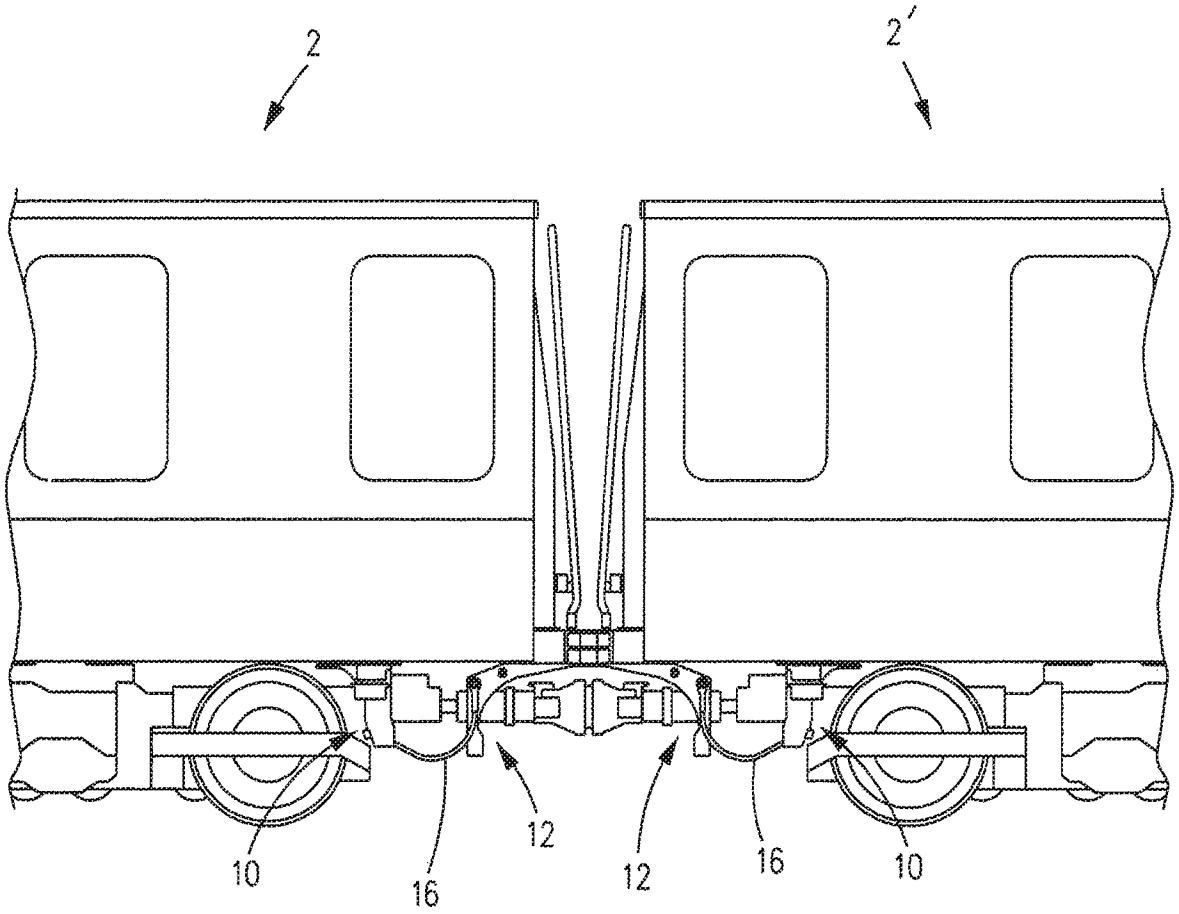
FIG. 7 is a side view of the rail cars shown in FIG. 6 in a second phase of the collision.

Referring to FIGS. 5-7 and with continuing reference to FIGS. 1-4B, in one preferred and non-limiting embodiment or example, CEM system 8 comprising coupler plate 10, coupler support 12, and coupler 14 is configured to operate as follows during a crash event involving rail car 2 and a rail car 2' which is similar to rail car 2 and will, therefore, not be specifically described herein. With that said, while the following description will focus on the response of CEM system 8 of rail car 2, it is to be understood that the CEM system 8 of rail car 2' will respond in a similar manner. Accordingly, the response of CEM system 8 of rail car 2' will not be described to avoid unnecessary redundancy.

Starting from the state shown in FIG. 5, in response to the application of a force F to coupler 46 of rail car 2 in the direction shown in FIG. 1, shock absorber 48 begins compression as shown in FIG. 6. During the initial compression of shock absorber 48, cables 16, via coupler support 12, initially avoid first end 11 of floor 4 from moving, e.g., in direction B shown in FIG. 1, in response to the application of force F (FIG. 1), thereby helping maintain floor 4 and energy absorbers 62 (FIGS. 2-3) in a pre-crash position.

As shown in FIG. 6, once shock absorber 48 is fully compressed and force F is applied directly to car body 5 and, hence, floor 4, whereupon first end 11 of floor 4 begins to move toward draft sill 6, as shown in FIG. 7, the tension in one or both cables 16 of CEM system 8 of rail car 2 relaxes (FIG. 7) whereupon coupler assembly 14 can pivot downward in direction D (FIG. 1) and, in an example, come to rest on cross-member 42 of coupler support 12. To this end, draft sill 6, coupler plate 10, coupler support 12, and coupler assembly 14 can be configured such that, as shown by comparing FIGS. 6 and 7, upon collapse of shock absorber 48 and force F being applied directly to car body 5 and, hence, floor 4, coupler support 12 can move toward coupler plate 10 and compressed coupler assembly 14 can come to rest on cross-member 42 of coupler support 12.

With continuing reference to FIGS. 6-7, once shock absorber 48 has collapsed and force F is applied directly to floor 4 and car body 5, the energy absorbers 62 (FIGS. 2-3) of rail car 2 can act in a designed manner to distribute force F over time, thereby providing controlled deformation of floor 4 proximate the first end 11 of floor 4.

Figure 8:
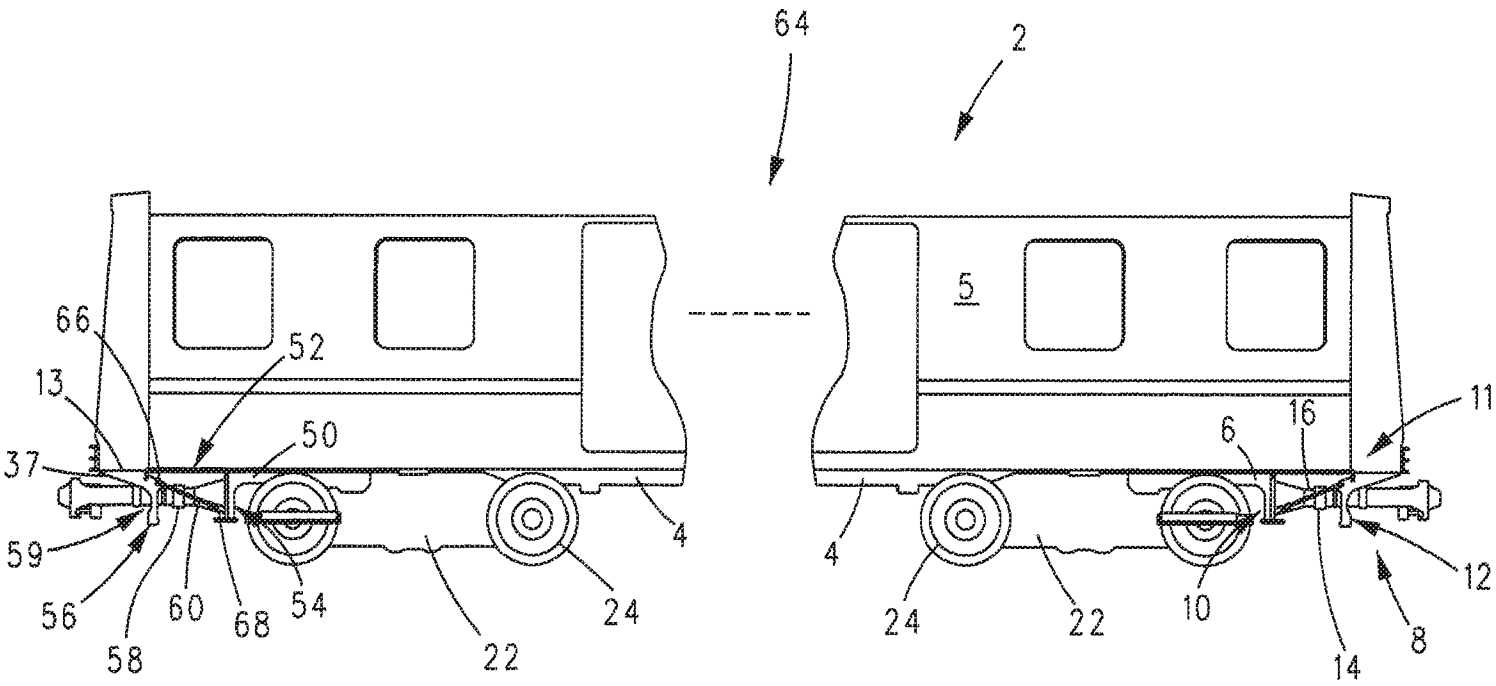
FIG. 8 is a side view of the portion of the rail car shown in FIG. 1 in relation to another (opposite) end-portion of the rail car at the other end that also includes a CEM system in accordance with the principles of the present invention.

With reference to FIG. 8 and with continuing reference to FIGS. 1-3, in one preferred and non-limiting embodiment or example, a second end 13 of floor 4 can include a second draft sill 50 depending from floor 4. As shown in FIG. 8, draft sill 6 can be positioned between first end 11 of floor 4 and a position 64 of rail car 2 intermediate first end 11 and second end 13 of floor 4. Second draft sill 50 can be positioned between second end 13 of floor 4 and position 64. Second CEM system 52 can include a second coupler plate 54 coupled to second draft sill 50 and depending from floor 4 between second draft sill 50 and second end 13 of floor 4. A second coupler support 56 can depend from a second end frame 37 between second coupler plate 54 and second end 13 of floor 4. A second elongated coupler assembly 58 can extend from second coupler plate 54 in a direction of second end 13 of floor 4 via an opening 59, e.g., a U-shaped opening, defined by second coupler support 56 and floor 4. At least one cable 60 can be connected between second coupler support 56 and second coupler plate 54. In another example, this at least one cable 60 can be connected between second coupler plate 54 and directly to end frame 37. Second draft sill 50, including second coupler plate 54, second coupler support 56, second coupler assembly 58, and once more cables 60 can be similar to draft sill 6, coupler plate 10, coupler support 12, coupler assembly 14, and the one or more cables 16 described above and can operate in the same manner.

Each cable 60 connected between second coupler support 56 and second coupler plate 54 can have a first end 66 connected to second coupler support 56 proximate floor 4 and a second end 68 connected to second coupler plate 54 proximate a portion thereof opposite (spaced from) floor 4. In an example, the at least one cable 60 connected between second coupler support 56 and second coupler plate 54 can include a first cable 60 connected between second coupler support 56 and second coupler plate 54 on one side on floor 4 and a second cable 60 connected between second coupler support 56 and second coupler plate 54 on an opposite side of floor 4.

Having thus described examples of CEM systems, a method of forming a CEM system on a rail car 2 comprising an elongated floor 4 supporting a rail car body 5 and a draft sill 6 depending from the bottom of floor 4 will now be described.

In one preferred and non-limiting embodiment or example, coupler plate 10 is connected to floor 4 between draft sill 6 and end 11 of floor 4, with coupler plate 10 extending away (downward) from the bottom of floor 4. Coupler support 12 is connected to end frame 15 between coupler plate 10 and end 11 of floor 4, with coupler support 12 extending away (downward) from the bottom of floor 4. One end of coupler assembly 14, having an elongated body, is connected to coupler plate 10, with the elongated body of coupler assembly 14 extending from coupler plate 10 in a direction of end 11 of floor 4 via opening 44 defined by coupler support 12 and floor 4. Finally, at least one cable 16 is connected in tension between coupler plate 10 and end frame 15, either directly or through coupler support 12.

In one preferred and non-limiting embodiment or example, each cable 16 can be installed pre-tensioned prior to connection between coupler support 12 and coupler plate 10. In an example, each cable can be pre-tensioned to about 22 kN. Cables 16 can be available from Hercules SLR, Pointe-Claire, Quebec, Canada.

In one preferred and non-limiting embodiment or example, coupler plate 10 can have first side 34 facing coupler support 12, second side 36 coupled to draft sill 6, a top edge 26 coupled to floor 4, and a bottom edge 28 facing away from floor 4.

In one preferred and non-limiting embodiment or example, each cable 16 can have first end 18 connected to coupler support 12, e.g., an arm 38 or 40 of coupler support 12, proximate floor 4 and a second end 20 connected to coupler plate 10 proximate bottom edge 28 of coupler plate 10.

In one preferred and non-limiting embodiment or example, each cable can have first end 18 connected to end frame 15 proximate floor 4 and the second end 20 connected to coupler plate 10 proximate bottom edge 28 of coupler plate 10.

In one preferred and non-limiting embodiment or example, each cable 16 can have first end 18 connected to end frame 15 proximate floor 4 and second end 20 connected to draft sill 6 distal floor 4, e.g., via bottom edge 28 of coupler plate 10.

In one preferred and non-limiting embodiment or example, each cable 16 can have first end 18 connected to coupler support 12, e.g., an arm 38 or 40 of coupler support 12, proximate floor 4 and a second end 20 connected to draft sill 6 distal floor 4, for example, proximate bottom edge 28 of draft sill 6.

In one preferred and non-limiting embodiment or example, coupler support 12 can include cross-member 42 spaced from floor 4 and extending laterally between the sides of rail car body 5, and a pair of spaced arms 38, 40 extending between the ends of cross-member 42 and floor 4, wherein opening 44 is defined between cross-member 42, arms 38 and 40, and floor 4.

In one preferred and non-limiting embodiment or example, finally, and as shown best in FIG. 3, coupler plate 10 and coupler support 12 can be coupled to floor 4 in spaced relation.

In one preferred and non-limiting embodiment or example, the CEM system 8 described herein find particular application in rail cars where the bogies are positioned closer to the ends of the floor which leaves little or no room for traditional draft sills. Accordingly, the draft sills 6 and 50 described herein, when compared to prior art draft sills, are positioned closer to the ends of floor 4 to accommodate the movement (rotation) of bogies 22 when in use. The CEM systems described herein can, in an example, provide adequate and progressive energy absorption in case of a crash event, while allowing the draft sill 6 to be sufficiently rigid and restrained under normal operation with the help of cables 16.

Referring to FIG. 5, during normal operation, coupler assembly 14 can be subjected to tension loads, for example when accelerating and pulling a trailing rail car, or to compression loads, for example when braking and being pushed by a trailing car. Coupler assembly 14 can also be subjected to low speed impacts (i.e. low energy), for example when two adjacent rail cars are being coupled. Coupler assembly 14 is designed for such loads and impacts and can momentarily elastically deform under such low speed impacts and will spring back to its original position once the loads are no longer applied. In case of high speed (i.e. high energy) impacts, coupler assembly 14 can be incapable of absorbing all the energy by elastic deformation. Such high energy impact can also be known as a crash or crash event. In an example, such crash can occur, for example, when one rail car derails and hits a fixed obstacle; when one rail car hits an obstacle on the tracks such as a car or truck at a crossing; or when two rail cars on a same track collide. This later example will be used in the following description as a non-limiting example. Although two rail cars are involved in this example of a crash, only the events on a single example rail car equipped with the CEM system described above will be described. Moreover, it is envisioned that both ends of the example rail car can experience a crashed simultaneously. However, for the sake of simplicity, only a crash at one end of the example rail car will be described. It will be understood, however, that should the rail car be crashed at both ends, the same principles would apply.

With reference to FIGS. 5-7, each CEM system described herein can decompose the crash into two phases. In the first phase, the shock absorber 48 of coupler assembly 14 absorbs a first portion or all of the energy of the crash by elastically deforming (compressing on itself without permanent damage). This is depicted in FIG. 5. If the crash energy is smaller than the energy absorption capacity of the coupler assembly 14, then the shock absorber 48 simply springs back to its original position, without sustaining damage, once the load is removed. If the crash energy is smaller than the energy absorption capacity of the coupler assembly 14 while still larger than the energy level the shock absorber 48 may absorb by elastic deformation, then the shock absorber 48 of the coupler assembly 14 is permanently damaged, but the two colliding rail cars have not otherwise contacted each other. This is depicted in FIG. 6. The coupler assembly 14, being mounted on the mounting plate 10 of the draft sill 6, transfers the loads it is subjected to draft sill 6. These loads are resisted by the draft sill 6 itself and by the at least one cable 16 which, being pre-tensioned, is capable of taking its share of such crash related loads. Each cable 16 transfers the portion of these crash related loads it experiences to end frame 15, whereupon the cable 16 provides additional rigidity and strength to the draft sill 16 in case of low energy impacts or crashes where coupler assembly 14 deforms elastically or plastically, but where there is no contact between the end frames of the colliding rail cars.

In one preferred and non-limiting embodiment or example, if the crash energy is larger than the energy absorption capacity of the coupler assembly 14, then the coupler assembly 14 is insufficient for preventing the car bodies of the two colliding rail cars from contacting each other. In such a case, once the coupler assembly 14 has absorbed all the energy it is capable of absorbing, or once it has deformed to the point where it no longer extends beyond the end (e.g., first end) of end frame 15 of rail car body 5, first end 11 of the end frame 5 will come into contact with the obstacle (likely through its respective anti-climber 39), in an example, the second incoming colliding rail car. This situation is depicted in FIG. 7.

During this second phase of the crash event, energy absorbers 62, located behind and connected to anti-climber 39, deform by collapsing on themselves in a longitudinal direction along the length of floor 4, thereby absorbing at least a portion of the crash energy by said deformation. During this second phase, CEM system 8 gradually collapses, starting at the first end 11 of rail car body 5 towards the center of the rail car body 5. As end frame 15 is being displaced toward the center of the rail car body 5, cables 16 buckle (FIG. 7), thereby avoiding the application of forces through cables 16 against draft sill 6. In an example, this avoids pushing against draft sill 6 through cables 16, avoiding unwanted deformation of draft sill 6 and end frame 5. In an example, because cables 16 can buckle, the deformation of the energy absorbers 62 can be better controlled since cables 16 cannot induce unwanted force or torque (since the force is not aligned with the energy absorbers 62) on energy absorbers 62.

As can be seen, disclosed herein is a rail car 2 comprising: an elongated floor 4 supporting a rail car body 5; an end frame 15 proximate a first end of the floor; a draft sill 6 depending from the floor 4; and a CEM system 8 comprising: a coupler plate 10 coupled to the draft sill 6 and depending from the floor 4 between the draft sill 6 and a first end 14 of the floor 4; an elongated coupler assembly 14 extending from the coupler plate 10 in a direction of the first end 11 of the floor 4; and at least one cable 16 connected between the coupler plate 10 and the end frame 15.

Each cable 16 can have a first end 18 connected to the end frame 15 proximate the floor 4 and a second end 20 connected to the coupler plate 10 proximate a portion 28 thereof opposite the floor 4.

Each cable 16 can be connected in tension between the coupler plate 10 and the end frame 15.

The tension of each cable 16 can be pre-set between 22 kilonewtons (kN) and 40 kN.

The at least one cable 16 can include: a first cable 16 connected between the end frame 15 and the coupler plate 10 on one side of the floor 4; and a second cable 16 connected between the end frame 15 and the coupler plate 10 on an opposite side of the floor 4.

The rail car 2 can further include a bogie 22 having wheels 24 coupled to the floor 4 proximate an end of the draft sill 6 opposite the end frame 15.

The coupler plate 10 can include top and bottom edges 26, 28 extending laterally between sides of the rail car body 5, wherein the top edge 26 is coupled to the floor 4 and the bottom edge 28 is positioned away from the floor 4 opposite the top edge 26; a pair of side edges 30, 32 that extend between the top and bottom edges 26, 28 of the coupler plate 10 on opposite sides of the coupler plate 10; a first face (or side) 34 to which a first end of the coupler assembly 14 is connected; and a second face (or side) 36 that faces away from the coupler assembly 14.

The at least one cable 16 can be connected to the end frame 15 via a coupler support 12. The coupler support 12 can depend from the end frame 15.

The coupler support 12 can be U-shaped including a pair of arms 38, 40 extending from a cross-member 42 that extends laterally between sides of the end-frame 15; the end of each arm 38, 40 opposite the cross-member 42 can be coupled to the end-frame 15; and an opening 44 can be defined between the end-frame 15 and the U-shape of the coupler support 12.

The coupler assembly 14 can be connected to the coupler plate 10 and can extend towards the end-frame 15 through the opening 44 of the coupler support 12. The coupler assembly 14 can include a shock absorber.

The rail car 2 can further comprise a second end frame 37 proximate a second end 13 of the floor 4; a second draft sill 50 depending from the floor 4, wherein the draft sill 6 is positioned between the first end 11 of the floor 4 and a position 64 intermediate the first end 11 and the second end 13 of the floor 4, and the second draft sill 50 is positioned between the second end 13 of the floor 4 and the position 64 intermediate the first and second ends 11, 13 of the floor 4; and a second CEM system 52 comprising: a second coupler plate 54 coupled to the second draft sill 50 and depending from the floor 4 between the second draft sill 50 and the second end 13 of the floor 4; a second elongated coupler assembly 58 extending from the second coupler plate 54 in a direction of the second end 13 of the floor 4; and at least one cable 60 connected between the second end frame 37 and the second coupler plate 54.

Each cable 60 connected between the second end frame 37 and the second coupler plate 54 is in tension and has a first end 66 connected to the second end frame 37 proximate the floor 4 and a second end 68 connected to the second coupler plate 54 proximate a portion thereof opposite the floor.

The at least one cable 60 connected between the second end frame 37 and the second coupler plate 54 can include: a first cable 60 connected between the second end frame 37 and the second coupler plate 54 on one side of the floor 4; and a second cable 60 connected between the second end frame 37 and the second coupler plate 54 on an opposite side of the floor 4.

Also disclosed herein is a method of forming a CEM system 8 on a rail car 2 comprising an elongated floor 4 supporting a rail car body 5 and a draft sill 6 depending from a bottom of the floor 4, the method comprising: connecting a coupler plate 10 to the floor 4 between the draft sill 6 and an end 11 of the floor 4, with the coupler plate 10 extending downward away from the bottom of the floor 4; connecting a coupler support 12 to the floor 4 between the coupler plate 10 and the end 11 of the floor 4, with the coupler support 12 extending downward away from the bottom of the floor 4; connecting one end of a coupler assembly 14 having an elongated body to the coupler plate 10, with the elongated body extending from the coupler plate 10 in a direction of the end 11 of the floor 4 via an opening 44 defined by the coupler support 12; and connecting at least one cable 16 in tension between the coupler support 12 and the coupler plate 10.

The method can further include providing each cable 16 pre-tensioned prior to connection between the coupler support 12 and the coupler plate 10.

The coupler plate 10 can have a first side 34 facing the coupler support 12, a second side 36 coupled to the draft sill 6, a top edge 26 coupled to the floor 4, and a bottom edge 28 facing away from the floor 4.

Each cable 16 can have a first end 18 connected to the coupler support 12 proximate the floor 4 and a second end 20 connected to the coupler plate 10 proximate the bottom edge 28 of the coupler plate 10.

The coupler support 12 can include a cross-member 42 spaced from the floor 4 and extending laterally between sides of the floor 4 and a pair of spaced arms 38, 40 extending between the cross-member 42 and the floor 4, wherein the opening 44 is defined between the cross-member 42, the arms 38, 40, and the floor 4.

The coupler plate 10 and the coupler support 12 can be coupled to the floor 4 in spaced relation.

Also disclosed is a rail car body that comprises an elongated floor 4; an end frame 15 proximate an end 11 of the floor 4; a draft sill 6 depending from the floor 4, the draft sill 6 including a coupler plate 10; a crash energy management (CEM) system 8 including a longitudinally collapsible structure 48, the longitudinally collapsible structure 48 disposed between the end frame 15 and the coupler plate 10 and being operative to transfer loads between the end frame 15 and the coupler plate 10; and at least one structural cable 16 connected between the draft sill 6 and the end frame 15, the at least one structural cable 16 being operative to transfer loads between the draft sill 6 and the end frame 15.

The cable 16 can be connected to a portion of the draft sill 6 spaced from the floor 4. The cable 16 can be connected under tension between the end frame 15 and the draft sill 6. The tension of the cable can be between 10 kilonewtons (kN) and 40 kN, in particular, between 8 kN and 25 kN. The cable 16 can be connected to the end frame 15 proximate the floor.

A coupler support 12 can depend from the end frame 15, wherein the cable 16 can be connected to the end frame 15 via the coupler support 12. An elongated coupler assembly 14 can extend from the coupler plate 10 in a direction of the end 11 of floor 4 via an opening 44 defined by the coupler support 12. Two cables 16 can be provided, wherein each cable 16 can be located on a different side of the coupler assembly 14.

The collapsible structure of the CEM system can be operative to collapse longitudinally, whereupon the end frame 15 moves longitudinally closer to the draft sill 6, whereupon the cable 16 is no longer under tension and is no longer operative to transfer loads between the draft sill and the end frame.

Finally, also disclosed is a rail car comprising the rail car body described above and two bogies, wherein each one of the two bogies can be located at a different end of the rail car body.

Although the invention has been described in detail for the purpose of illustration based on what is currently considered to be the most practical preferred and non-limiting embodiments, examples, or aspects, it is to be understood that such detail is solely for that purpose and that the invention is not limited to the disclosed preferred and non-limiting embodiments, examples, or aspects, but, on the contrary, is intended to cover modifications and equivalent arrangements that are within the spirit and scope of the appended claims. For example, it is to be understood that the present invention contemplates that, to the extent possible, one or more features of any preferred and non-limiting embodiment, example, or aspect can be combined with one or more features of any other preferred and non-limiting embodiment, example, or aspect.

The invention claimed is:

1. A rail car comprising:

an elongated floor;

an end frame proximate a first end of the floor;

a draft sill extending from the floor; and a crash energy management (CEM) system comprising:

a coupler plate fixedly connected to the draft sill and extending from the floor between the draft sill and a first end of the floor;

an elongated coupler assembly extending from the coupler plate in a direction of the first end of the floor; and at least one cable connected between the coupler plate and the end frame, the at least one cable being fixedly connected to the end frame, wherein the at least one cable is pre-tensioned and configured for transferring a portion of crash-related loads from the draft sill to the end frame.

2. The rail car of claim 1, wherein each cable has a first end connected to the end frame proximate the floor and a second end connected to the coupler plate proximate a portion thereof opposite the floor.

3. The rail car of claim 1, wherein the tension of each cable is between 22 kilonewtons (kN) and 40 kN.

4. The rail car of claim 1, wherein the at least one cable includes:

a first cable connected between the end frame and the coupler plate on one side of the floor; and a second cable connected between the end frame and the coupler plate on an opposite side of the floor.

5. The rail car of claim 1, further including a bogie having wheels coupled to the floor proximate an end of the draft sill opposite the end frame.

6. The rail car of claim 1 wherein the at least one cable is connected to the end frame through a coupler support, the coupler support extending from the end frame.

7. The rail car of claim 6, wherein:

the coupler support is U-shaped including a pair of arms extending from a cross-member that extends laterally between sides of the end frame;

the end of each arm opposite the cross-member is coupled to the end frame; and an opening is defined between the end frame and the U-shape of the coupler support.

8. The rail car of claim 7, further comprising the coupler assembly connected to the coupler plate and extending towards the end frame and through the opening of the coupler support, the coupler assembly having a shock absorber.

9. The rail car of claim 1, further comprising:

a second end frame proximate a second end of the floor;

a second draft sill extending from the floor, wherein the draft sill is positioned between the first end of the floor and a position intermediate the first end and the second end of the floor, and the second draft sill is positioned between the second end of the floor and the position intermediate the first and second ends of the floor; and a second CEM system comprising:

a second coupler plate coupled to the second draft sill and extending from the floor between the second draft sill and the second end of the floor;

a second elongated coupler assembly extending from the second coupler plate in a direction of the second end of the floor; and at least one cable connected between the second end frame and the second coupler plate.

10. The rail car of claim 9, wherein each cable has a first end connected to the second end frame proximate the floor and a second end connected to the second coupler plate proximate a portion thereof opposite the floor.

11. The rail car of claim 9, wherein the at least one cable connected between the second end frame and the second coupler plate includes:

a first cable connected between the second end frame and the second coupler plate on one side of the floor; and a second cable connected between the second end frame and the second coupler plate on an opposite side of the floor.

12. A method of forming a crash energy management system on a rail car comprising an elongated floor supporting a rail car body and a draft sill extending from a bottom of the floor, the method comprising:

fixedly connecting a coupler plate to the floor between the draft sill and an end of the floor, with the coupler plate extending away from the bottom of the floor;

connecting a coupler support to the floor between the coupler plate and the end of the floor, with the coupler support extending away from the bottom of the floor;

connecting one end of a coupler assembly having an elongated body to the coupler plate, with the elongated body extending from the coupler plate in a direction of the end of the floor via an opening defined by the coupler support; and connecting at least one cable in tension between the coupler support and the coupler plate, wherein the at least one cable is fixedly connected to the coupler support, wherein the at least one cable is configured for transferring a portion of crash-related loads from the draft sill to an end frame proximate to the end of the floor.

13. The method of claim 12, further including providing each cable pre-tensioned prior to connection between the coupler support and the coupler plate.

14. The method of claim 12, wherein the coupler plate has a first side facing the coupler support, a second side coupled to the draft sill, a top edge coupled to the floor, and a bottom edge facing away from the floor.

15. The method of claim 14, wherein each cable has a first end connected to the coupler support proximate the floor and a second end connected to the coupler plate proximate the bottom edge of the coupler plate.

16. The method of claim 12, wherein the coupler support includes a cross-member spaced from the floor and extending laterally between sides of the floor and a pair of spaced arms extending between the base and the floor, wherein the opening is defined between the base, the arms, and the floor.

17. The method of claim 12, wherein the coupler plate and the coupler support are coupled to the floor in spaced relation.

18. A rail car body comprising:

an elongated floor;

an end frame proximate a first extremity of the floor;

a draft sill extending from the floor, the draft sill fixedly connected to a coupler plate;

a crash energy management (CEM) system having a longitudinally collapsible structure, the longitudinally collapsible structure being connected between the end frame and the coupler plate and being operative to absorb at least partially crash energy and to transfer loads between the end frame and the coupler plate; and at least one structural cable connected between the draft sill and the end frame, the at least one structural cable being fixedly connected to the end frame, pre-tensioned and operative to transfer loads between the draft sill and the end frame.

19. The rail car of claim 18, wherein the at least one cable is connected to the draft sill distal a level of the floor.

20. The rail car of claim 18, wherein the tension of the at least one cable ranges between 10 kilonewtons (kN) and 40 kN.

21. The rail car of claim 20, wherein the tension of the at least one cable ranges between 18 kilonewtons (kN) and 25 kN.

22. The rail car of claim 18, wherein the at least one cable is connected to the end frame proximate a level of the floor.

23. The rail car of claim 18, further comprising a coupler support extending from the end frame, the at least one structural cable being connected to the end frame via the coupler support.

24. The rail car body of claim 23, further comprising an elongated coupler assembly extending from the coupler plate in a direction of the first extremity of the floor via an opening defined by the coupler support.

25. The rail car body of claim 24, further comprising two structural cables, each one of the two structural cables being located on a different side of the coupler assembly.

26. The rail car body of claim 18, wherein the collapsible structure of the CEM is operative to collapse longitudinally so that the connected end frame gets longitudinally closer to the draft sill and so that the at least one structural cable is no longer under tension and is no longer operative to transfer loads between the draft sill and the end frame.

27. A rail car comprising:

the rail car body of claim 18; and two bogies, each one of the two bogies being located at a different end of the rail car body.

* * * * *